US009679550B2

(12) United States Patent
Fishman et al.

(10) Patent No.: US 9,679,550 B2
(45) Date of Patent: Jun. 13, 2017

(54) METHOD AND DEVICE USING LOW INDUCTANCE COIL IN AN ELECTRICAL PICKUP

(71) Applicant: Fishman Transducers, Inc., Wilmington, MA (US)

(72) Inventors: Lawrence Fishman, Winchester, MA (US); John Eck, Medford, MA (US)

(73) Assignee: Fishman Transducers, Inc., Wilmington, MA (US)

( * ) Notice: Subject to any disclaimer, the term of this patent is extended or adjusted under 35 U.S.C. 154(b) by 0 days.

(21) Appl. No.: 15/145,022

(22) Filed: May 3, 2016

(65) Prior Publication Data

US 2016/0284331 A1 Sep. 29, 2016

Related U.S. Application Data

(63) Continuation of application No. 14/594,795, filed on Jan. 12, 2015, now Pat. No. 9,355,630.

(60) Provisional application No. 61/925,965, filed on Jan. 10, 2014.

(51) Int. Cl.

| | |
|---|---|
| ***G10H 3/18*** | (2006.01) |
| ***G10H 3/14*** | (2006.01) |
| *G10H 1/12* | (2006.01) |

(52) U.S. Cl.

CPC ..... *G10H 3/186* (2013.01); *G10H 3/14* (2013.01); *G10H 3/143* (2013.01); *G10H 3/18* (2013.01); *G10H 1/12* (2013.01); *G10H 3/181* (2013.01); *G10H 2220/505* (2013.01)

(58) Field of Classification Search

CPC ..... G10H 3/18; G10H 3/181

USPC ..... 84/726

See application file for complete search history.

(56) References Cited

U.S. PATENT DOCUMENTS

| | | | | | |
|---|---|---|---|---|---|
| 4,117,413 | A * | 9/1978 | Moog | H03G 5/025 | 330/126 |
| 4,253,374 | A * | 3/1981 | Watterman | G10G 7/02 | 84/455 |
| 4,351,216 | A * | 9/1982 | Hamm | G10H 3/182 | 324/76.13 |
| 4,481,854 | A * | 11/1984 | Dugas | G10H 1/12 | 84/723 |
| 4,580,478 | A * | 4/1986 | Brosh | G10H 1/0555 | 84/688 |
| 4,838,139 | A * | 6/1989 | Fiori, Jr. | G10H 1/182 | 334/75 |
| 5,189,242 | A * | 2/1993 | Usa | G10H 3/26 | 84/743 |
| 5,367,120 | A * | 11/1994 | Hoshiai | G10H 1/125 | 84/616 |

(Continued)

FOREIGN PATENT DOCUMENTS

| | | |
|---|---|---|
| DE | 4238837 | 5/1993 |
| WO | WO 2012/052987 | 4/2012 |

*Primary Examiner* — David Warren

(74) *Attorney, Agent, or Firm* — Pearl Cohen Zedek Latzer Baratz LLP

(57) ABSTRACT

A pickup device for an electric instrument may include at least one permanent magnet to detect vibrations from the electric instrument's strings. The pickup device may further include at least one coil within a magnetic field of the permanent magnet. The coil may be coupled to one or more of a plurality of selectable filters. The pickup device may be an integrated assembly and fittable within a standard-sized pickup cavity on the electric instrument.

19 Claims, 8 Drawing Sheets

(56) References Cited

U.S. PATENT DOCUMENTS 5,591,931 A * 1/1997 Dame ..... G10H 1/12 381/2
5,854,437 A * 12/1998 Merrick ..... G10G 7/02 84/454
6,034,316 A * 3/2000 Hoover ..... G10H 3/186 84/738
6,211,671 B1 * 4/2001 Shattil ..... H05K 9/00 324/225
7,812,243 B2 10/2010 Celi et al.
7,989,690 B1 * 8/2011 Lawing ..... G10H 3/181 84/723
8,143,509 B1 * 3/2012 Robertson ..... G10H 3/186 84/604
8,269,095 B1 * 9/2012 Wallace ..... G10H 3/143 84/726
8,320,584 B2 11/2012 Sheets
8,519,251 B2 8/2013 Lingel
8,692,101 B2 * 4/2014 Ryle ..... G10H 1/053 84/622
8,735,710 B2 * 5/2014 Yamabata ..... G10H 1/18 84/626
2003/0019349 A1 * 1/2003 Green ..... G10D 1/085 84/731
2005/0109197 A1 5/2005 Garrett et al.
2005/0162247 A1 7/2005 Beller
2005/0211081 A1 * 9/2005 Bro ..... G10H 1/18 84/737
2007/0003073 A1 * 1/2007 Iriarte ..... G10H 1/0083 381/77
2007/0168063 A1 * 7/2007 Gallien ..... G10H 3/187 700/94
2011/0290099 A1 * 12/2011 Franklin ..... G10H 3/182 84/733
2012/0103169 A1 * 5/2012 Lingel ..... G10H 3/08 84/726
2012/0272815 A1 * 11/2012 Lingel ..... G10H 3/143 84/726
2013/0076542 A1 * 3/2013 Tanaka ..... H03K 17/9647 341/22
2013/0239788 A1 * 9/2013 Mills ..... G10H 3/181 84/726
2013/0263721 A1 * 10/2013 Shavit ..... G10H 1/055 84/626
2013/0312591 A1 * 11/2013 Mills ..... G10H 3/181 84/726
2013/0327202 A1 * 12/2013 Mills ..... G10H 3/181 84/726
2014/0260906 A1 * 9/2014 Welch ..... G10H 3/182 84/603
2014/0270215 A1 * 9/2014 Lin ..... G10H 1/0091 381/61
2014/0298974 A1 * 10/2014 Kawahashi ..... G10H 3/18 84/622
2015/0059562 A1 * 3/2015 Burmas ..... G10H 1/44 84/742
2015/0199949 A1 * 7/2015 Fishman ..... G10H 3/181 84/726
2016/0284331 A1 * 9/2016 Fishman ..... G10H 3/186

* cited by examiner

METHOD AND DEVICE USING LOW INDUCTANCE COIL IN AN ELECTRICAL PICKUP

PRIOR APPLICATION DATA

This application is a continuation of prior U.S. application Ser. No. 14/594,795, filed Jan. 12, 2015, entitled "Method and Device Using Low Inductance Coil in an Electrical Pickup" which in turn claims benefit of prior U.S. Provisional Application Ser. No. 61/925,965, filed Jan. 10, 2014, each of which being incorporated by reference herein in its entirety.

FIELD OF THE PRESENT INVENTION

The present invention relates to electrical instrument pickups for stringed instruments.

BACKGROUND

Electric guitar players may be able to select different equipment to produce a wide variety of tonal characters such as "warm" jazz guitar tones, "bright" pop guitar tones, "overdriven" rock guitar tones, and heavily distorted metal guitar tones. The desired tone may vary depending upon the style of music, the preferences of the individual musician, or the song being performed. Musicians can control tonal character by skill and playing style, and by selection of equipment and its settings. Players of other instruments besides guitar, including bass guitar, ukulele, mandolin, violin, viola, cello, bass, and banjo, can similarly produce desired tonal characteristics. Equipment selected may be, for example, guitars, pickups, or effects pedals.

Tonal character may be affected by the choice of electrical pickups. On an electric guitar or other electrified instrument, conventional pickups may be electromagnetic devices that convert string vibrations into an electrical signal by reacting to the movement of the metal guitar strings. This electrical signal represents the musical notes played by the musician, with tonal character derived from the string vibrations as captured and the inherent characteristics of the individual pickup. This electrical signal from the pickups may be further modified downstream by external devices such as effects pedals and amplifiers, and is then converted to audible sound by loudspeakers.

Traditional electric guitar pickups may be passive electromagnetic circuits, which include magnets and conductive coils, but no battery or powered circuit. The coils may be made by winding copper wire around a plastic bobbin using a wire-winding machine. Other electric guitar pickups may be active and may include, for example, a battery that powers a preamp circuit. The active components may be added to traditional, passive pickups. Differentiation among pickup products may be implemented by intentionally varying the construction and materials used to produce the pickup.

Conventional electric guitar and bass guitar pickups may be mounted in a semi-permanent manner Some pickups have a coil tap switch, allowing the musician to remove one set of coils from the signal chain, and in some cases enable another set of coils to be inserted to produce a different sound. Although conventional tone controls and coil taps can change sound of a particular pickup they cannot change the fundamental defining "voice" of a particular brand or model. During a performance a musician cannot select different model or branded pickup voices from one song to another; he or she must put down the instrument and select a different instrument with different pickups, and may need to disconnect and reconnect cables unless each instrument is connected to a dedicated amplifier. Replacing pickups is a time-consuming task requiring some effort and skill with hand tools and soldering. In addition, the sound produced by an individual pickup of a certain model or variety may differ from other pickups within that model, as it may differ in its physical characteristics. Due to these physical limitations, characteristics of conventional guitar sounds may not be able to be changed on one instrument.

SUMMARY

A pickup device for an electric instrument may include at least one permanent magnet to detect vibrations from the electric instrument's strings. The pickup device may further include at least one coil within a magnetic field of the permanent magnet. The coil may be coupled to one or more of a plurality of selectable filters. The pickup device may be an integrated assembly and fittable within a standard-sized pickup cavity on the electric instrument.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
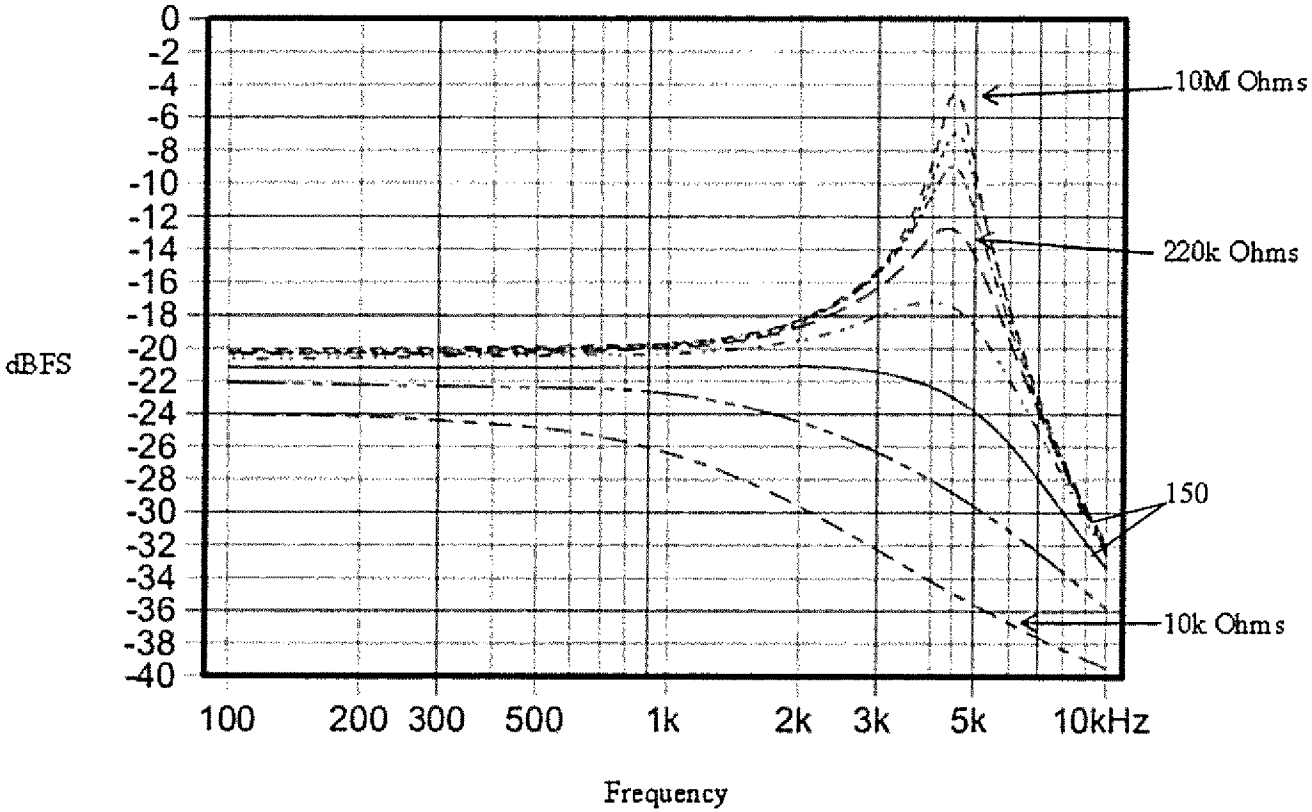
FIGS. 1A and 1B are graphs of a frequency response of an example pickup, according to embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well known features may be omitted or simplified in order not to obscure the present invention.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices.

Embodiments of the invention may provide a system or method for producing sounds or audio from an instrumentalist's actions on an electric instrument stringed instrument, including an electric guitar or electric violin, for example A pickup may be used to pick up or detect the vibration of nearby magnetic or soft-magnetic strings (e.g., metal strings). The vibrations may be detected due to the change in magnetic field surrounding the pickup's magnetic rods that are individually placed in close vicinity with the instrument's strings.

A conventional passive electromagnetic pickup may be a physical device that includes coils of wire within a magnetic field placed in proximity to the steel or other metal strings of a musical instrument. The magnetic field may come from a magnetic material placed within the radius of the coil. The magnetic material may be a permanent magnet placed in a row, for example, creating a fixed magnetic field when the musical instrument is not played. A magnet may be permanent because it is made of a material that creates its own persistent magnetic field. The permanent magnet may take any form, such as a magnetic bar or magnetic rods, for example. Movement of a vibrating ferromagnetic or metal string may alter the fixed condition of the magnetic field through which the string passes, by varying the magnetic reluctance in the field. The variation in the reluctance of the field may induce a current in the coil. The current induced in the coil may provide signal characteristics proportional to the movement of the string. The output of the coil may be connected via a shielded cable to the input of an audio amplifier and the sound produced may be a reproduction of the vibrating characteristics of the string.

Embodiments of the invention may provide a system that includes a pickup with a constant or predictable frequency response coupled with selectable digital or analog filters that can replicate, mimic, model, or reproduce frequency response characteristics of traditional pickups or can create new frequency response characteristics that provide a unique set of tones or colors. The inductance of a pickup's coils may vary with the number of turns of its wire, e.g., a greater number of turns in the coil may relate to a greater inductance value in the coil. Since conventional or traditional pickup coils may include a higher number of turns, conventional coils may be of higher inductance than those used with embodiments of the present invention (although embodiments of the present invention may also use such higher-turn coils). According to embodiments of the invention, the pickup may include a coil that is in the vicinity of a magnetic field provided by a permanent magnet. The coil may be wire wound or a printed coil (e.g., a coil that is manufactured on a compact, printed circuit board). The coil may be a low inductance coil with for example less than 3000 turns (1600 or 1000 turns, for example). Numbers of turns over 3000 may be used. A low inductance for the coil may be, for example, less than 500 milliHenries. The coil may have a flat frequency response over the audible range for human hearing (e.g., 20 Hz to 20 kHz), allowing for digital or analog shaping to reproduce sounds from other pickups or to create entirely new sounds. The flat frequency response may mean that it has a constant or near constant power output across the frequency range for audible listening. Digital and analog shaping of the frequency response may be created by active circuitry or programming. In other embodiments, coils with high inductance may be used for a higher power frequency response (e.g., higher than 500 milliHenries). Several factors may affect the sound characteristics of a pickup:

Magnetic structure (part of the physical pickup)—pickups may have magnetic structures that are similar to pickups they're emulating. Pickups for Strat guitars may use six rod magnets through the coil; classic humbuckers may use bar magnets below the coil with pole screws through the coils; modern humbuckers may use bar magnets below the coil with pole blades through the coils.

Low inductance coils (part of the physical pickup). These may be PCB (printed circuit board) coils or wire-wound coils.

Gain (part of the active circuit). Low-inductance coils are low-output relative to commonly available pickups. Gain boosts the output to the levels of other traditional pickups.

Filtering (part of the active circuit). Filtering may allow tuning the response of the pickup to emulate the voice of target pickups, or to create unique voices.

Different tonal characteristics can result from production changes such as different types and configurations of magnets, different amounts of wire in the coils, single-coil vs. hum-cancelling configuration, and different physical configuration of the components. A typical electromagnetic pickup may be manufactured with thousands of turns of small gage coated wire. Variable capacitance values may result from variances in coating thickness, which may depend on humidity conditions during the coating application and manufacturing precision, and these changes may occur even within the same standard model. During manufacturing, variations in tension and winding speed may stretch the wire. This stretching will cause changes in the resistance and capacitance of the coil which will result in each coil having different resonant frequencies and thus different sound characteristics for each individual pickup. A typical pickup coil may be manufactured with 3000-8000 turns, for example. While the greater amount of turns may provide a higher power or energy output, they may significantly attenuate signal output at higher frequencies. Embodiments of the invention may solve or mitigate the problems of many pickups manufactured today. For example, some multi-voice pickups may require a complex and unwieldy set of knobs and switches in order to adjust gain and alter frequency characteristics. However, this manual tuning of filters may be impractical for producing repeatable and predictable sounds or tones during a live performance. Other pickups may require extra electronic parts to power the pickup, which may be inconvenient or require alterations of the guitar's body. According to embodiments of the invention, pickups described herein may be fully contained or integrated within a guitar's pickup cavity. By using low inductance coils which may, for example, be printed on circuit boards, a hum canceling configuration may be more effective in cancelling hum than traditional wire wound coils in a humbucking configuration. Further, the predictability of neatly stacked coil layers may ensure electrical repeatability not available in traditional designs. Traditional passive designs may add more turns to the coil for more output, but this may shift the resonant peaks down in frequency and destroys the bright and transparent character that is characteristic of the classic "under wound designs". Embodiments of the invention may be able to deliver classic sounds at higher output levels.

The pickup may behave as a typical resonant circuit, with the pickup's coil providing inductance, capacitance, and resistance. When the strings of the electric guitar are vibrating or moving due to a musician's playing, the strings change or affect the magnetic field provided by the magnetic rods and induce time varying voltage in the pickup's coil (thus also producing an alternating current). The frequency of the varying voltage or alternating current may correspond with the frequency of the notes being played on the electric guitar string. Because the pickup may behave as a resonant circuit, each guitar pickup may exhibit a unique frequency response characteristic which describes the changing power output of sounds produced by a guitar, depending on the frequency of the sounds played. Each pickup may have, for example, one or more unique peak or resonant frequencies at which the output sound of a guitar using the pickup is largest. Other unique characteristics of the frequency response of a pickup may be, for example, a cutoff frequency, slope of attenuation or other transfer function characteristics. The frequency response of a pickup may describe the characteristic sounds or tones of an electric guitar, e.g., "warm" jazz guitar tones, "bright" pop guitar tones.

Many traditional pickups may be preferred by musicians for their sounds, but may be sensitive to parasitic capacitance and resistance that may be inherent in the coils or unintentionally added to the pickup's resonance circuit, thus affecting its frequency response and sounds. Single coil pickups, for example, may have a desirable sound to musicians, but they may also transmit a 60 Hz/50 Hz hum due to AC-powered devices in the environment and from other noise sources. Single coil pickups may be sensitive, for example, to magnetic fields generated by transformers, fluorescent lamps, and other sources of interference, and may pick up hum and noise from these sources. The hum may be mitigated, for example, by vertically stacking two high-inductance coils, but high frequency content may be attenuated in the audible range of music and the pickups may lose their desirable sound. Dual coil or humbucking pickups may use two specially configured coils to minimize this interference or hum.

Figure 1B:
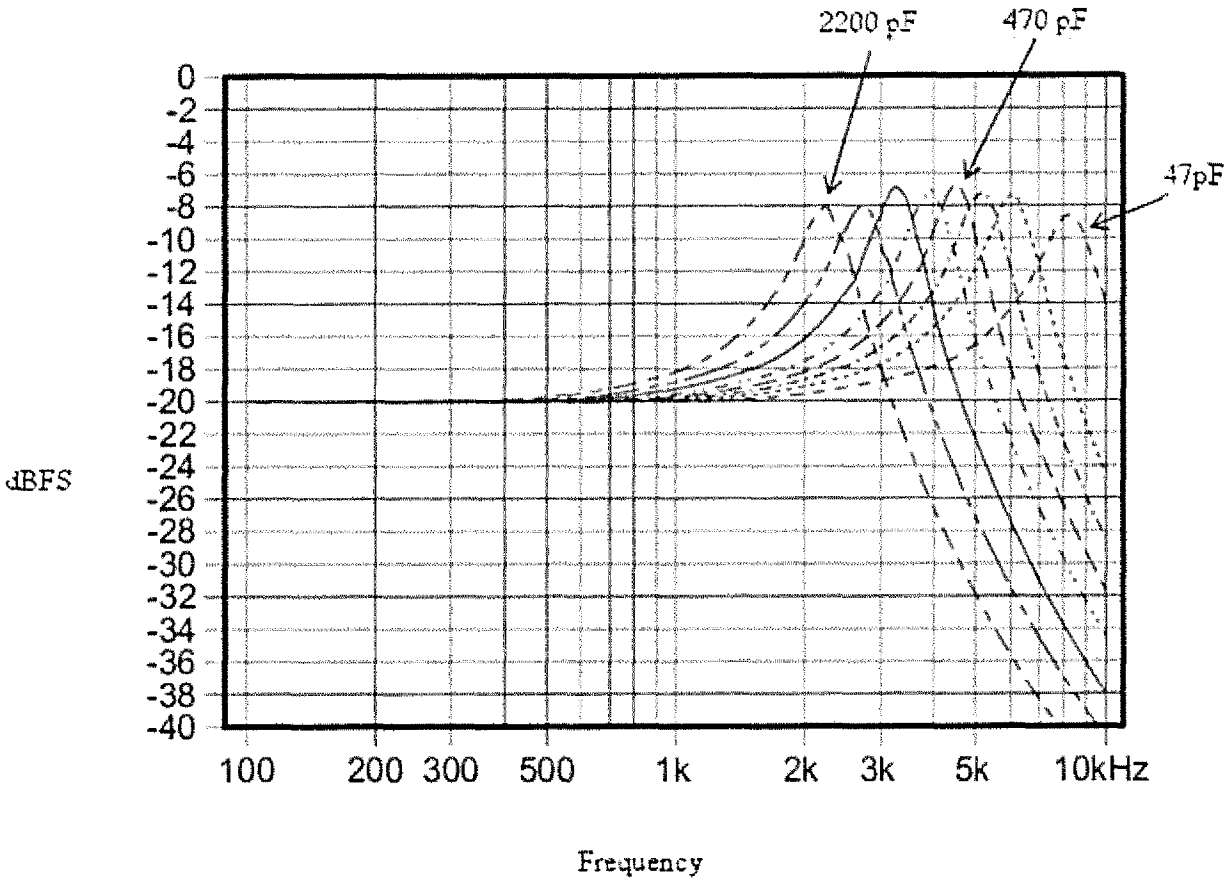

FIGS. 1A and 1B are graphs of a frequency response of an example pickup, according to embodiments of the invention. For a Fender Stratocaster ("Strat") pickup manufactured in 1972, for example, the frequency response curves 150 of its pickup may vary depending on resistive load applied to the pickup, such as a load from a connected amplifier, a volume control or a tone control, for example As shown in FIG. 1A, the Strat pickup may generally have a peak frequency around 4.7 kHz (kilohertz). When 10 M Ohms are applied to the pickup, the pickup may have higher power output at its peak frequency, than when less resistance is applied, such as at 220 k Ohms or 10 k Ohms. The Strat pickup may also have a different peak frequency due to the capacative loading of a shielded cable that connects the pickup to an amplifier. These load values are determined by the design and length of the connecting cables, for example. As shown in FIG. 1B, if a Strat pickup with constant resistance includes an extra 2200 pF, the peak frequency may be at 2.4 kHz, whereas a Strat pickup having 47 pF may have a peak frequency at around 8 kHz. Both resistance and capacitance can alter the tone characteristics and frequency response produced or provided by the guitar's pickup drastically. Musicians intending to maintain a type of tone or sound may have difficulty replacing pickups or using different kinds of peripherals (e.g., amplifiers or effects pedals) because the different capacitive and resistive loads provided by the peripherals may affect each pickup differently.

Figure 1C:
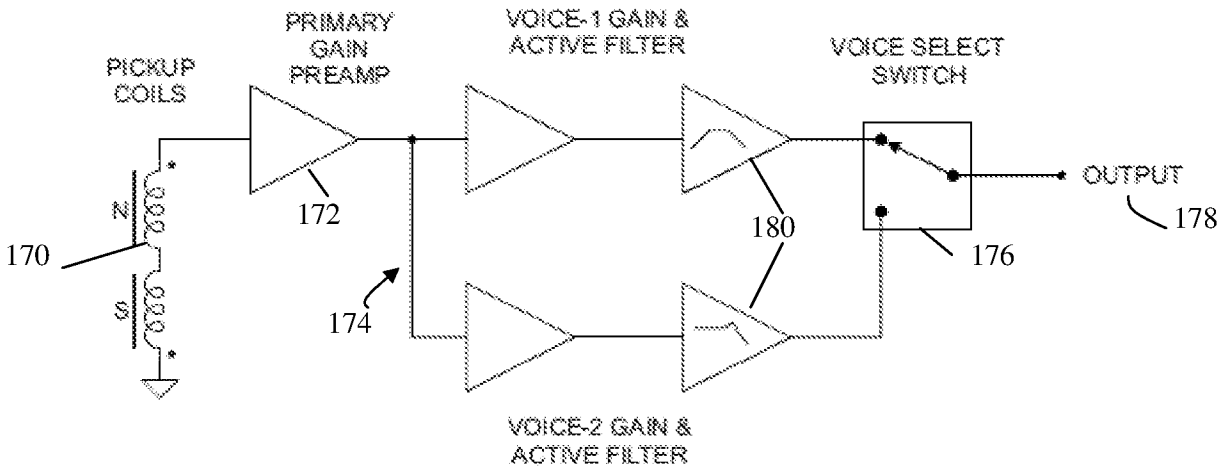
FIG. 1C is a circuit diagram of a pickup including a plurality of selectable filters, according to embodiments of the invention.

FIG. 1C is a circuit diagram of a pickup including a plurality of selectable filters, according to embodiments of the invention. Other or different components and arrangements may be used. As explained above, a pickup may behave as a resonance circuit. The pickup coils may behave as inductors 170, and the output signal from the coil may be fed into a primary gain preamp 172 in order to maintain a desired output level. The active filters 174 may receive a signal from the coils and apply any combination of high-pass, low-pass, or band pass filters in order to shape the desired frequency response 180 of the pickup. A switch 176, toggle, push button, push knob, or other device may be used to toggle or select between the two voices provided by the filters 174. (More than two filters may be possible). The output 178 from the pickup may be connected to an amplifying device which may affect the capacitive and resistive load on the circuit.

Mimicking the sounds or frequency response of traditional passive pickups may involve analyzing and reproducing the magnetic field properties of the traditional pickups and measuring the frequency response and output level. The measured parameters may then be loaded into a signal processor development system which allows real time audio auditioning and fine tuning of the response with feedback from expert musicians. The development system may determine the optimal filter coefficients for the pickup's transfer function. These coefficients may be imported into a simulation program, and an exact replica response may be implemented with analog components.

Figure 2:
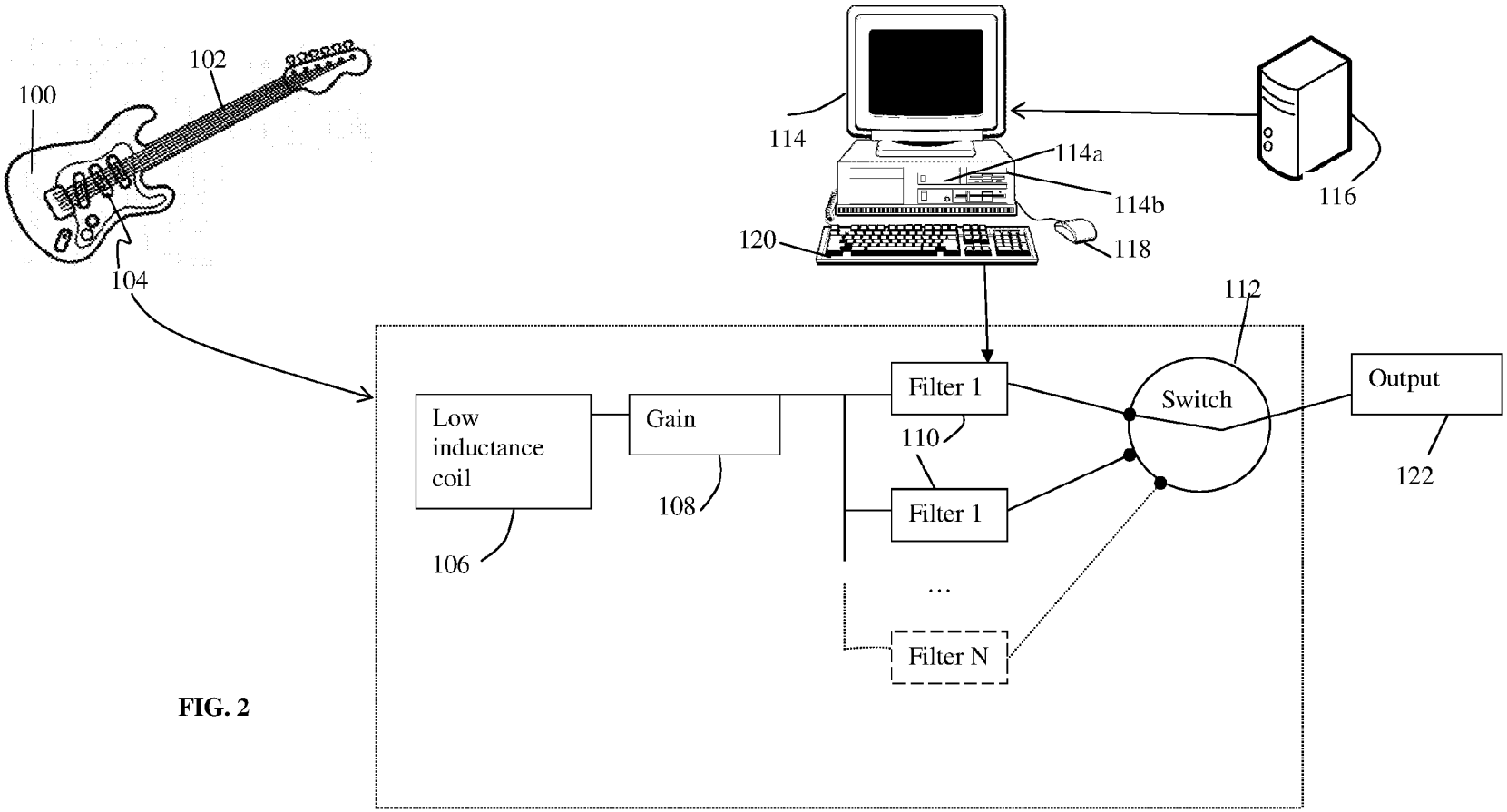
FIG. 2 is a diagram of a pickup system for an electric guitar, according to embodiments of the invention.

FIG. 2 is a diagram of a pickup system for an electric guitar, according to embodiments of the invention. An electric instrument 100, such as an electric guitar for example, may include strings 102 that a musician plays on and a pickup 104 to detect or pick up vibrations from the strings 102. The strings' vibration may cause a change in the pickup's magnetic field and induce time varying voltage in a low-inductance coil 106. This voltage may include information on the notes played on the strings or the rate of vibration on the string. While each string may vibrate near its own magnetic rod, the magnetic field changes may together induce a time varying voltage which may be output and interpreted into audio by a speaker. The pickup 104 may include magnetic rods surrounded by or having around the rods a low-inductance coil 106 coupled to an amplifier circuit 108 that increases the voltage gain of the coil's 106 output. The output of the gain amplifier circuit 108 may be coupled to or connected to one or more filters 110 which may be selectable or controlled by a switch 112.

In one embodiment, the pickup 104 may include N analog filters Filter 1 to Filter N, connected to physical pickup coils, possibly via other circuitry such as gain amplifier circuit 108. Switch 112 or other device may route the signal from the coils, representing the string vibrations, through one of the filters 110, to produce a modified or modeled signal. Analog filters as known in the art may be used, such as any combination of low pass filters, high pass filters, band pass filters, band stop filters or resonating filters. For analog modeling, analog filters may emulate or improve upon the sound of popular pickups sold by different companies or manufacturers. The analog filter may include a second order low-pass filter with a resonant peak to mimic the natural behavior of passive pickups. Other configurations may be used. Some filters used with embodiments of the present invention may deliver sound recipes that are otherwise impossible to achieve using traditional passive filtering techniques. Some filters may also deliver sounds that have not been produced by existing pickups.

In one embodiment, a pickup may contain two or more independent active tone-shaping filters self-contained within the standard pickup form factor. Each filter may be designed to provide a different voice output given the same magnet-coil input. Leads on the filter board allow ordinary open/closed circuits to determine which of the filters is connected to the output. If these leads are connected to a switch, a guitar player will be able to switch back and forth between the two voices while playing. Other methods of selecting a filter or voice may be used.

In one embodiment, the pickup 104 shown in FIG. 1 may include N digital or analog filters 110, Filter 1-Filter N, connected to physical pickup coils, possibly via other circuitry such as gain circuitry. The switch 112 or other device may route the signal from the coils, representing the string vibrations, through one of the filters, to produce a modified or modeled signal. For digital filters, a digital switch on a DSP or microprocessor may apply different filters depending on an indicated setting.

For analog filters, the filters 110 may be pre-manufactured circuits in a combination of, for example, low pass filters, high pass filters, and resonance circuits. The switch 112 may be mechanical, and allow current to flow through one filter 110 at a time. Switches other than mechanical switches may be used. For digital filters, the filters 104 may be implemented by software installed on a processor such as a microprocessor or FPGA (field-programmable gate array), for example, such that the processor is configured to act as one or more filters. The digital filters (expressed as software or code which may cause the processor to filter in a certain way) may be downloaded or installed from a computer 114. The digital filters may initially be edited on software with a user interface that allows users to edit the desired frequency response characteristics of a filter, such as editing filter coefficients and resonant frequencies. Users may also download filters onto the computer 114 which may be saved on a server 116 or the web and install them on one or more of the filters coupled to the coil 106. Computer 114 may include memory 114*a* and one or more processors 114*b* to run editing software. The digital filters may be edited through input devices such as a mouse 118 or keyboard 120. After the signal from the coils passes through a filter, the filtered signal may be output 122 to other filters, such as in effects pedals, or through an amplifier or speaker, for example.

Figure 3A:
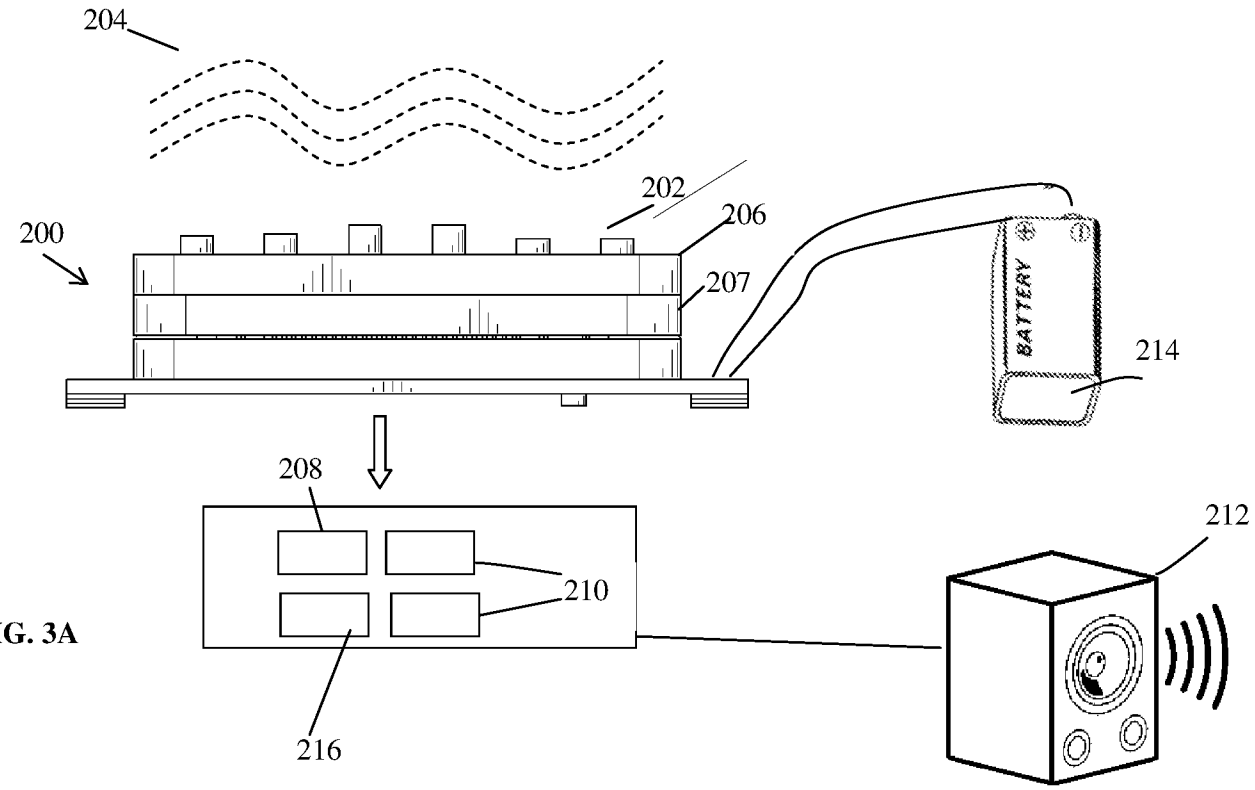
FIG. 3A is an illustration of a pickup, according to embodiments of the invention.

FIG. 3A is an illustration of a pickup 200, according to embodiments of the invention. The pickup may include one or more of magnetic rods 202 (or other form of permanent magnet) which have a magnetic field that is responsive to or affected by the vibration of metallic strings 204 which may be plucked or played by a musician. The magnetic rods 202 may alternatively be a magnetic bar or other shape. For the magnetic rods 202, there may be one rod 202 for one string 104, for example. The magnetic rods 202 may be surrounded by a wire or printed coil 206 or have such a wire or coil around the rods, such as a coil printed on a silicon PCB (printed circuit board). In some embodiments the coil may be placed within the magnetic field of the magnetic rods 202, and not necessarily surrounding the magnets. The change in the rods' 202 magnetic field may induce a time varying voltage in the coil 206, producing an analog signal that represents notes that a musician is playing, for example. The analog signal may be input into a processor or controller 208 with selectable digital or analog filters (for example as explained in FIGS. 1C and 2). The filtered signal may be output or amplified to a speaker 212. The pickup 200, together with the coil 206, rods 202, and controller 208 with filters, may fit into a standard location for pickups on an electric guitar, so that the pickup 200 can easily replace a guitar's original pickup without changing the guitar's body. With the controller and filters, the pickup may emulate or mimic other older models of pickups or produce different sounds altogether. The pickup 200 may further be retrofitted or placed onto older, standard electric guitar models. The older electric guitar models may have initially been manufactured with a different pickup, but pickup 200 may have the dimensions which allow it to be installed into the older, standard guitar model. Standard electric guitar models may include, for example, the Gibson Les Paul, Gibson ES-325, Gibson Futura, Fender Telecaster, Fender Stratocaster, or other electric guitar models.

Spacing between a combination of coils may also affect a pickup's sound. A larger spacing between the top and bottom coils may cancel hum without canceling signal. This may be possible by stacking low-profile, low-inductance coils 206 and providing a spacer 207 between then. Traditional high-inductance coils may be much taller, so a stacked-coil pickup allows little or no space between the coils. In traditional pickups, the bottom coil (the hum canceling coil) may start much closer to the strings and picks up more signal. As a result, a traditional stacked-coil pickup not only cancels hum, it may cancel a significant amount of signal. Embodiments of the invention may cancel the hum, but the fact that the bottom coil is farther from the strings means there may be less signal cancellation.

The pickup 200, including the coil 206, magnetic rods 202, selectable filters 210, spacer 207, processor 208 and a housing (see, e.g., housing 303 in FIG. 3) may be integrated or combined into a single assembly or a single item or part so that the pickup may be fittable within standard-sized pickup cavities. For example, for a single-coil or single-width standard pickup cavity, the pickup may be no more than approximately 18.3 mm wide and 83.8 mm long, and 12.6 mm high. In another example, for a soap bar humbucker pickup cavity on a Gibson Les Paul guitar, a standard-sized pickup may be no more than approximately 70.1 mm by 38.3 mm by 17 mm tall. Other standard sizes for pickup cavities may be possible. The pickup assembly may further be retrofitted into standard electric guitars or older electric guitar models manufactured in the 1950's, for example.

One or more processors (e.g., processors 114*a* and 208) may be used for processing, transmitting, receiving, editing, manipulating, synthesizing or patching digital or analog audio signals. The processor(s) may be coupled to one or more memory devices. Computers may include one or more controllers or processors, respectively, for executing operations and one or more memory units, respectively, for storing data and/or instructions (e.g., software) executable by a processor. The processors may include, for example, a central processing unit (CPU), a digital signal processor (DSP), a microprocessor, a controller, a chip, a microchip, an integrated circuit (IC), or any other suitable multi-purpose or specific processor or controller. Memory units may include, for example, a random access memory (RAM), a dynamic RAM (DRAM), a flash memory, a volatile memory, a non-volatile memory, a cache memory, a buffer, a short term memory unit, a long term memory unit, or other suitable memory units or storage units. Computers may include one or more input devices, for receiving input from a user or agent (e.g., via a pointing device, click-wheel or mouse, keys, touch screen, recorder/microphone, other input components) and output devices for displaying data to a customer and agent, respectively.

Various embodiments of the invention may include a sensor system that converts string vibrations into an electrical signal, analog-to-digital audio conversion, previously-created digital models of the response characteristics of a plurality of pickups stored in memory, a method to edit and update the digital models, a method to communicate with external software and libraries of digital models, a method for selecting which digital model or models to apply, a method for producing a digital output signal that overlays the sound characteristics of the digital model on the notes played by the musician, digital-to-analog audio conversion to produce an analog electrical output signal, standard ¼-inch phone jack to connect to external devices such as pedals and amplifiers, and battery or batteries (e.g., battery 214 in FIG. 3A) to power the system components, with all elements embedded in the body of an electric guitar. The battery 214 or other power source may be fully integrated in or within a control cavity of the electric guitar, for example, to avoid any alteration to the instrument body.

Embodiments of the invention may provide the ability to select from a plurality of digital models of desirable pickup tones, to edit those models, to store those models in the guitar or other musical instrument, and to select while playing the instrument, resulting in rapid change to the tone of the electric instrument that is provided to external equipment such as amplifiers and effects pedals.

A pickup may convert physical vibration generated by the musical instrument strings to an analog electrical signal. The electrical signal travels through a wire to an analog-to-digital converter, which converts the electrical signal to a high-resolution digital signal. The high-resolution digital signal is routed to a programmable digital signal processor (DSP), processor, computer processor, microprocessor, or controller, for example.

The processor (e.g., processor 208) may include software programmed with a plurality of individual previously-created digital models of specific conventional pickups, or of edited versions of specific conventional pickups, or of designed models of theoretical pickups. The software may be stored in memory 216. Each digital model describes frequency response, output level, transient response, frequency-dependent decay curve, or other desired frequency characteristics. The software may further generate a digital output signal that represents the notes played by the stringed instrument player, digital processed to reflect the tone and response characteristics of the digital model. The filter or model may take as input analog signals from the coil of the pickup, may alter those signals, and may produce as output a modified signal that is based on the notes played on the guitar and which sounds as if a pickup of a certain type or model has been used to generate the signal.

The digital output signal from the processor may be further routed to a digital-to-analog converter, which creates an analog electrical signal that is an accurate representation of the digital output signal. The analog electrical signal is further routed to the connectors of a conventional ¼-inch phone jack which may be exposed. By plugging a cable with a conventional ¼-inch phone plug into the jack, the signal output of the invention may be connected to external devices such as amplifiers and effects pedals. A user may be able to select from a menu of digital models (e.g., on a user interface) that mimic or emulate traditional pickups. The digital models may be implemented by selecting a pre-made filter or creating a new filter. For example, in one embodiment, a multi-position switch on the face of the guitar or other musical instrument allows convenient and rapid selection of digital models by turning a rotary switch, repositioning a blade switch, or pressing a button, for example. Other methods of selection and other selection devices may be used.

During a performance, the musician can switch to select one or more of a plurality of digital models of different "vintage" pickups and popular pickup products. The player changes the switch position to switch from pickup model to pickup model. Each switch position may be for example is a digital model of a single coil, humbucking or active pickup that with some filters or models may be instantly recognized and valued by the marketplace. The selector switch may offer both visual and tactile feedback to the player. Visually, various embodiments of the invention may display a list of available pickup models, with an indicator to show which model is selected. Tactile response may come from a detent at each stop, allowing the player to select without looking.

Digital models may include those mimicking desirable pickups including but not limited to: 1950's low-output single coil as on vintage Fender Stratocaster, high-output single-coil such as Seymour Duncan hot rails, noise-canceling single-coil, single-coil as in bridge position of vintage Fender Telecaster, single-coil as in neck position of vintage Fender Telecaster, vintage P90, 1957 vintage PAF humbucker, Gibson '57 Classic, Gibson '57 classic plus, Gibson mini-humbucker, Seymour Duncan JB, DiMarzio Super Distortion, high-output neck humbucker, trembucker as on vintage Gretsch Country Gentleman, vintage Burns Tri-Sonic or modern replica such as Adeson, EMG 81 active pickup, EMG 85 active pickup, EMG 60 active pickup, EMG 81X active pickup, EMG 85X active pickup, Seymour Duncan Blackout, Seymour Duncan Bill Mustaine, Bill Lawrence L-48, Bill Lawrence L-90.

For example, a filter (e.g., filter 313) on a single width or single coil pickup may emulate or model a vintage single-coil sound by providing a frequency response to input signals that is unique to vintage single-coil sounds. The frequency response for the vintage single-coil sound may have a peak frequency of 4 kHz. The same single width pickup may also be able to emulate or model a hot Texas single-coil sound with a peak frequency of 3 kHz. The two voices emulated on the single width pickup may be selectable by a switch, for example. In another example, filters on a humbucker pickup may emulate a vintage PAF pickup with a peak frequency of 2.6 kHz using one filter, and provide a new sound with three peak frequencies, for example Other combinations may be possible.

Figure 3B:
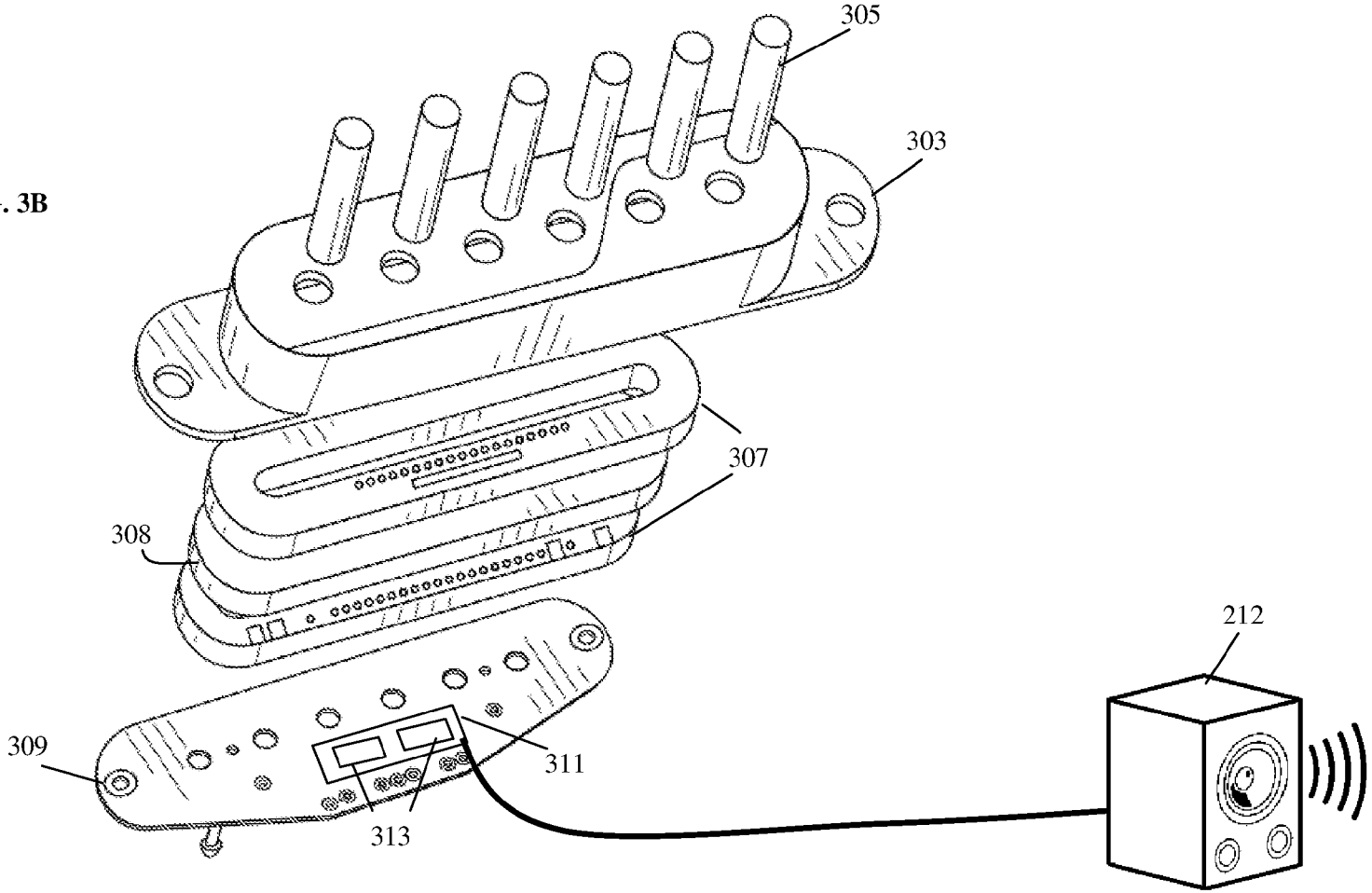
FIG. 3B is an exploded view of a pickup for an electric guitar, according to embodiments of the invention.

FIG. 3B is an exploded view of a pickup for an electric guitar, according to embodiments of the invention. Other arrangements may be used. The pickup may include housing 303 to protect or shield the coil and filters from external environmental interference. Housing 303 may be plastic or made of other insulating material. The housing 303 may include holes to support the magnetic rods 305 which provide a magnetic field to detect the guitar string's vibrations. The housing 303 may also cover the coils 307 and an optional spacer 308. The base plate 309 of the pickup may be a printed circuit board (PCB) with integrated controllers or processors 311 that filter signals from the coils 305. The base plate 309 may further be integrated with a plurality of selectable filters 313 that provide emulated pickup sounds.

Figure 5:
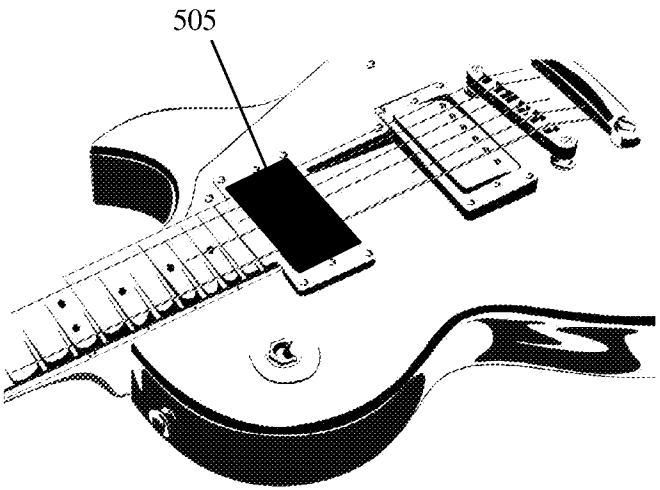
FIG. 5 is an illustration of standard pickup cavities on an electric guitar 501, according to embodiments of the invention.
Figure 5:
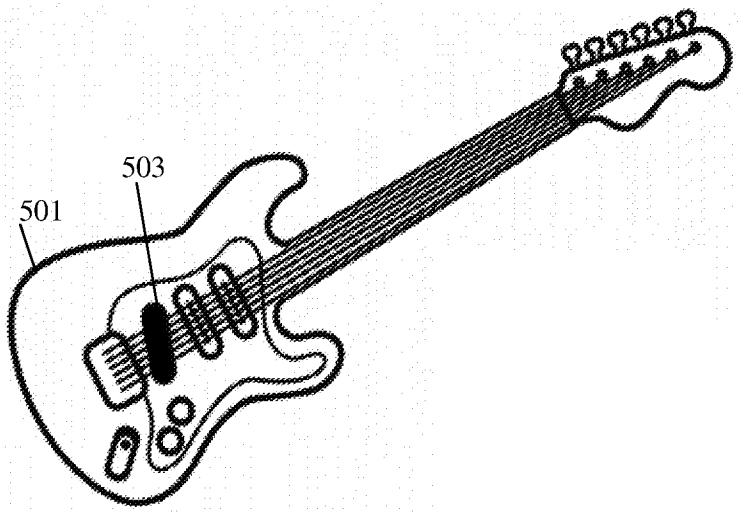

The pickup configuration may be integrated or incorporated in or within a standard pickup cavity on an electric guitar (see, e.g., FIG. 5).

Figure 4:
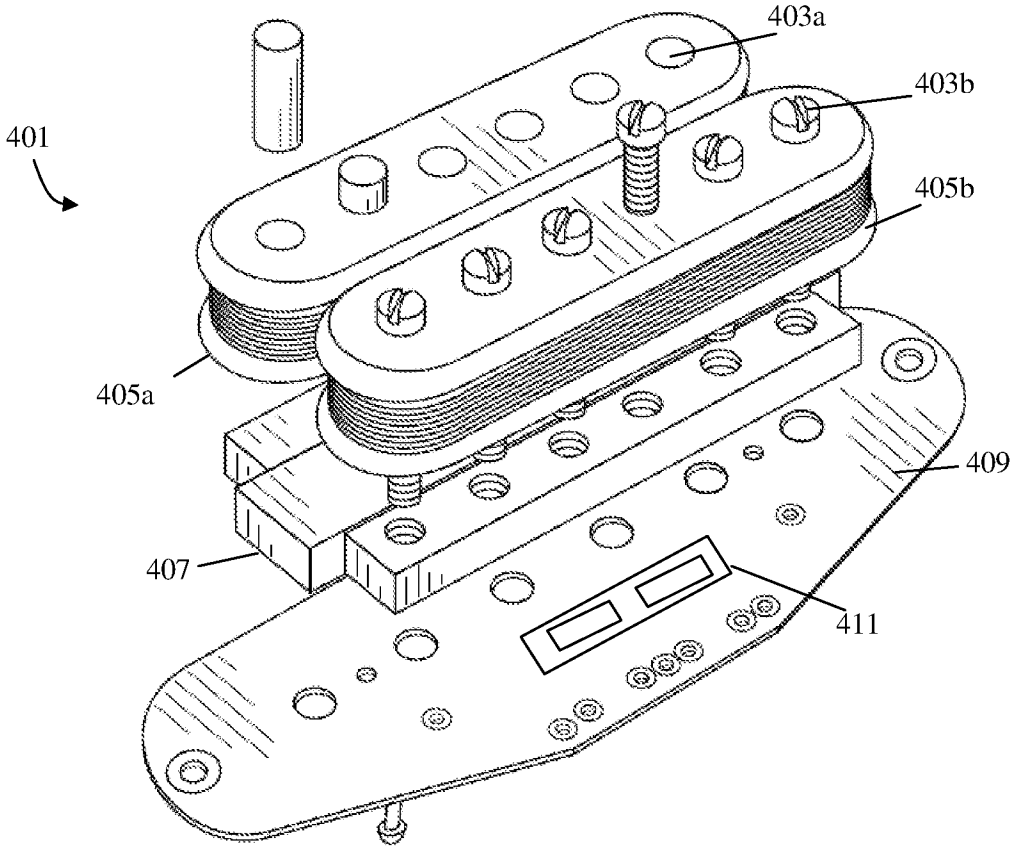
FIG. 4 depicts a hum canceling configuration of a pickup providing multiple voices, according to embodiments.

FIG. 4 depicts a hum canceling configuration of a pickup providing multiple voices, according to embodiments of the invention. Other coils and pickups, and other configurations, may be used. Instead of a single-width coil that may include stacked coils (see, e.g., FIG. 3B), a hum canceling or humbucker pickup 401 may include two sets of magnetic rods 403*a* and 403*b* and two wire wound coils 405*a* and 405*b*, for example, to surround or be arranged around each set of magnetic rods. The wire wound coils 405*a* and 405*b* may be wound with fewer turns, for example, in order to provide low inductance and predictable frequency response. An alnico bar magnet 407 may further magnetize the magnetic rods so that the produced magnetic field is stronger. Other kinds of magnets may be used, such as a ceramic bar magnet. A humbucker baseplate 409 may further be integrated with a plurality of selectable filters 411 that provide emulated pickup sounds. The pickup configuration may be integrated or incorporated in or within a standard pickup cavity on an electric guitar (see, e.g., cavity 505 in FIG. 5).

FIG. 5 is an illustration of standard pickup cavities on an electric guitar 501, according to embodiments of the invention. A few types of standard pickup cavities may be present on different types of guitars. In some guitars, more than one type of pickup cavity may be located on an electric guitar. One type of standard cavity may be a single coil or single width pickup cavity 503. Pickups described herein may include for example magnetic rods, a coil, and a plurality of selectable filters to produce a sound that mimics or emulates classic pickup sounds or other pickup sounds, and these elements may be fully integrated within a standard pickup cavity such as single width pickup cavity 503. The pickup's magnetic rods may further be spaced apart according to a standard size, e.g., 52.2 millimeters (mm) Another type of standard cavity may be a humbucker pickup cavity 505. The multi-voice pickups described herein may be integrated in such a way that no further modification of the electric guitar is required in order to install and use the pickup.

Embodiments of the invention may include an article such as a computer or processor readable non-transitory storage medium, such as for example a memory, a disk drive, or a USB flash memory device encoding, including or storing instructions, e.g., computer-executable instructions, which when executed by a processor or controller, cause the processor or controller to carry out methods disclosed herein. Some embodiments may include a combination of one or more general purpose processors and one or more dedicated processors such as DSPs (digital signal processors).

Thus, embodiments of the invention have been described with respect to what is presently believed to be the best mode with the understanding that these embodiments are capable of being modified and altered without departing from the teaching herein. Therefore, the invention should not be limited to the precise details set forth herein but should encompass the subject matter of the claims that follow and the equivalents of such modifications and changes as fall within the true spirit of the invention.

What is claimed is:

1. A pickup device for an electric musical instrument, comprising:

at least one permanent magnet to detect vibrations from the electric instrument's strings; and at least one coil within a magnetic field of the permanent magnet, wherein the coil is coupled to one or more of a plurality of selectable digital filters, wherein the magnet, the coil, and the plurality of selectable digital filters are an integrated assembly.

2. The pickup device of claim 1, wherein the digital filters are implemented in a digital signal processor.

3. The pickup device of claim 1, wherein the coil is wire-wound.

4. The pickup device of claim 1, wherein the integrated assembly is within a single width pickup cavity.

5. A pickup device for an electric musical instrument, comprising:

at least one permanent magnet to detect vibrations from the electric instrument's strings; and at least one low inductance coil, having less than 3000 turns, within a magnetic field of the permanent magnet, wherein the low inductance coil is coupled to one or more of a plurality of selectable digital filters, wherein the magnet, the low inductance coil, and the plurality of selectable digital filters are an integrated assembly.

6. The pickup device of claim 5, wherein the coil is wire-wound.

7. The pickup device of claim 5, wherein the coil has less than 3000 turns.

8. The pickup device of claim 5, wherein the coil has less than 1600 turns.

9. The pickup device of claim 5, wherein the coil is less than 500 milliHenries.

10. A pickup device for an electric musical instrument, comprising:

at least one permanent magnet to detect vibrations from the electric instrument's strings; and at least one printed coil within a magnetic field of the permanent magnet, wherein the printed coil is coupled to one or more of a plurality of selectable filters, wherein the magnet and the printed coil are an integrated assembly.

11. The pickup device of claim 10, wherein the filters are digital filters.

12. The pickup device of claim 10, wherein the integrated assembly is within a single width pickup cavity.

13. An audio pickup device for producing audio signals representing musical notes from an electric musical instrument, comprising:

at least one permanent magnet to detect vibrations from the electric instrument's strings; and at least one low inductance wire-wound coil, having less than 3000 turns, within a magnetic field of the permanent magnet, wherein the low inductance wire-wound coil is coupled to one or more of a plurality of selectable filters.

14. The pickup device of claim 13, wherein the coil has less than 1600 turns.

15. The pickup device of claim 13, wherein the coil is less than 500 milliHenries.

16. A pickup device for an electric musical instrument, comprising:

at least one permanent magnet to detect vibrations from the electric instrument's strings; and a single printed coil within a magnetic field of the permanent magnet, wherein the single printed coil is coupled to one or more of a plurality of selectable filters, wherein the magnet, the single printed coil, and the plurality of selectable filters are an integrated assembly.

17. The pickup device of claim 16 wherein the filters are digital.

18. A pickup device for an electric musical instrument, comprising:

at least one permanent magnet to detect vibrations from the electric instrument's strings; and at least one printed coil within a magnetic field of the permanent magnet, wherein the printed coil is coupled to a single filter, wherein the magnet, the printed coil, and the filter is an integrated assembly.

19. The pickup device of claim 18 wherein the at least one printed coil is a single printed coil.

* * * * *